US012790057B1

(12) United States Patent
Lau

(10) Patent No.: US 12,790,057 B1
(45) Date of Patent: Nov. 10, 2026

(54) PACKAGE CARTON VOID FILLING DEVICE, PACKING ASSEMBLY AND CARTON VOID FILLING METHOD

(71) Applicant: NxPac Limited, Hong Kong (CN)

(72) Inventor: Kachung Lau, Hong Kong (CN)

(73) Assignee: NxPac Limited, Hong Kong (CN)

( * ) Notice: Subject to any disclaimer, the term of this patent is extended or adjusted under 35 U.S.C. 154(b) by 0 days.

(21) Appl. No.: 19/326,175

(22) Filed: Sep. 11, 2025

(51) Int. Cl.
*B65B 61/22* (2006.01)
*B65B 57/04* (2006.01)

(52) U.S. Cl.
CPC ..... *B65B 61/22* (2013.01); *B65B 57/04* (2013.01)

(58) Field of Classification Search
CPC ..... B65B 55/20; B65B 57/12; B65B 2210/04; B65B 61/22; B65B 57/04
See application file for complete search history.

(56) References Cited

U.S. PATENT DOCUMENTS 6,286,569 B1 * 9/2001 Brandenburg ..... B65B 55/20 141/369
7,814,733 B2 * 10/2010 Carlson ..... B65B 55/20 53/472
8,997,440 B2 * 4/2015 Carlson ..... B65B 55/20 53/115
9,994,346 B2 * 6/2018 Carlson ..... B65B 57/12
2001/0017023 A1 * 8/2001 Armington ..... B65B 61/22 53/503
2008/0092488 A1 * 4/2008 Gabrielsen ..... B65B 55/20 53/115
2011/0308204 A1 * 12/2011 Corradi ..... B65B 57/14 53/115
2017/0183139 A1 * 6/2017 Wetsch ..... B65B 57/12
2023/0067806 A1 * 3/2023 Brandsetter ..... B65B 43/52
2024/0294293 A1 * 9/2024 Wetsch ..... B65B 55/20

* cited by examiner

*Primary Examiner* — Himchan Song
(74) *Attorney, Agent, or Firm* — Leason Ellis LLP

(57) ABSTRACT

A packaging carton void filling device, a packaging assembly, and a packaging void filling method. The device includes: a movable frame that moves along a filling path under the driving of a movement mechanism; a controller used to plan the filling path according to gaps in a package carton; a first pick-up mechanism having a connection seat connected to the movable frame and an acquisition unit connected to the connection seat, wherein the acquisition unit has a first state and a second state and is configured to pick or release void fill material by switching between the first state and the second state; and a compression mechanism connected to the connection seat and provided with a pressing part, wherein the pressing part moves along a path of a first direction under the driving of the compression mechanism for pressing and filling the material into the gaps.

15 Claims, 8 Drawing Sheets

PACKAGE CARTON VOID FILLING DEVICE, PACKING ASSEMBLY AND CARTON VOID FILLING METHOD

TECHNICAL FIELD

The present application relates to the technical field of packing, and in particularly to a package carton void filling device, a packing assembly, and a carton void filling method.

BACKGROUND

With the rise of online shopping, demand for express parcels in various regions is increasing daily. To meet the growing demand for express delivery, some enterprises use mechanized equipment to improve the packing efficiency of package cartons.

Currently, after items are loaded and packed into a package carton, void fill material is filled on the surface of the items before the carton is sealed to provide cushion, moisture resistance, and dustproof effect. Because the void fill material is flexible, it may not only protect the surface of the items when the package carton is sealed, but also fill a top space inside the package carton, thereby securing the items in place and reducing the risk of damage during transportation.

In related technologies, a void filling device mainly places void fill material into the top space inside the package carton. However, gaps may still exist between the items and vertical inner walls of the package carton or between the items themselves. These voids/gaps will also cause the items moving during transportation, resulting in a risk that the items in the package carton may still be damaged due to collision.

SUMMARY

The present application aims to provide a package carton void filling device to solve at least one of technical problems in the related art with at least a better choice or condition.

According to a first aspect of embodiments of the present application, a package carton void filling device, includes:

- a movement mechanism, provided with a movable frame, wherein the movable frame moves along a filling path under the driving of the movement mechanism;
- a controller, configured to plan the filling path according to gaps in a package carton;
- a first pick-up mechanism, including a connection seat connected to the movable frame, and an acquisition unit connected to the connection seat, wherein the acquisition unit has a first state and a second state and is configured to pick or release void fill material by switching between the first state and the second state;
- a compression mechanism, connected to the connection seat, and provided with a pressing part, wherein the pressing part moves along a path of a first direction under the driving of the compression mechanism for pressing and filling the material into the gaps.

The package carton void filling device according to the embodiments of the present application has at least the following beneficial effects. When gaps appear in a package carton due to loaded items, the controller obtains a corresponding coordinate data of these gaps in the package carton through specific detection means or a preset packing plan. After the first pick-up mechanism picks up the void fill material, the movement mechanism moves the first pick-up mechanism to a target gap according to the filling path. The first pick-up mechanism releases the picked void fill material into the target gap. Subsequently, the compression mechanism controls the pressing part to further press the void fill material into the target gap to ensure that the void fill material is completely filled into the target gap. This scheme may not only fill the void fill material into the inner top space of the package carton but also fill the void fill material into the gaps between the items and walls of the package carton, which is conducive to for fixing the position of the items in the package carton, reducing the risk of the items becoming loose during transportation, thereby effectively reducing the damage rate of items in the logistics process and improving the quality of express delivery.

According to some embodiments of the present application, the acquisition unit is provided with two clamping parts, a clamping space is formed between the two the clamping parts. The acquisition unit is configured to adjust an opening width of the clamping space by controlling the relative positions of the two the clamping parts.

According to some embodiments of the present application, the acquisition unit adjusts the opening width of a clamping space based on a corresponding size of a respective gap in the package carton.

According to some embodiments of the present application, a first actuation device is arranged on the acquisition unit and connected to the connection seat. The acquisition unit also includes two clamping parts, and the first actuation device is provided with a first movable part. The first actuation device is connected to at least one the clamping part through the first movable part. The first actuation device is configured to adjust the opening width of the clamping space by changing the relative positions of the two the clamping parts.

According to some embodiments of the present application, a rotation mechanism is provided between the movement mechanism and the movable frame or between the movable frame and the connection seat. The rotation mechanism has a rotation axis arranged along the first direction.

According to some embodiments of the present application, the number of the first pick-up mechanism is two or more. The connection seat of any one of the first pick-up mechanisms is connected to the movable frame through a quick-release structure. Each first pick-up mechanism has a clamping part of a varied length.

According to some embodiments of the present application, the acquisition unit is provided with a negative pressure adsorption component. The negative pressure adsorption component is connected with a negative pressure channel, and a control valve is provided on the negative pressure channel.

According to some embodiments of the present application, a rotation mechanism is arranged between the movement mechanism and the movable frame or between the movable frame and the connection seat. The rotation mechanism has a rotation axis arranged along the first direction.

According to some embodiments of the present application, the compression mechanism further comprises the pressing part and a second actuation device. The second actuation device is connected to the connection seat and provided with a second movable part. The second movable part is connected to the pressing part, so that the second actuation device is capable of driving the pressing part to move along the first direction.

According to some embodiments of the present application, the package carton void filling device further includes a visual detection unit. The visual detection unit has a detection direction toward the interior of the package carton. The controller plans the filling path through the visual detection unit.

According to a second aspect of embodiments of the present application, a packing assembly, includes:

a packing device, including a pick-up station, a plurality of scanners, a multi-axis robot, a plurality of visual probes, a plurality of code readers, a buffer station, a packing station, and a void fill dispenser; the pick-up station is used for placing an item container containing items, the packing station is used for storing a package carton to be filled, the multi-axis robot is provided with an execution unit, and the execution unit is connected with a second pick-up mechanism for picking and releasing items; the execution unit is movable among the pick-up station, the buffer station, and the packing station; a controller generates a packing plan when the scanners scan an information code of the item container, and generate a picking plan when the visual probes capture images of the items in the item container; the multi-axis robot sequentially picks up the items from the item container according to the picking plan; the code readers read an identification code of each picked item; by comparing the picking plan with the packing plan, the multi-axis robot carries items that not scheduled for the current packing round onto the buffer station for temporary storage, so that the package cartons are packed according to the packing plan; and the package carton void filling device according to any one of embodiments of the present application, wherein the first pick-up mechanism picks up void fill material dispensed from the void fill dispenser, and the controller plans the filling path for the movable frame according to the packing plan.

According to some embodiments of the present application, the multi-axis robot serves as the movement mechanism, and the movement range of the execution unit is extended to include the void fill dispenser.

According to some embodiments of the present application, the execution unit is connected with the second pick-up mechanism and the first pick-up mechanism through the movable frame, and the execution unit activates the second pick-up mechanism or the first pick-up mechanism by rotating the movable frame.

According to a third aspect of embodiments of the present application, a carton void filling method, applying the packing assembly, includes the following steps:

generating, by a controller, a packing plan when a plurality of scanners scan an information code of an item container;

generating, by the controller, a picking plan when a plurality of visual probe capture images of items in the item container;

picking, by a multi-axis robot, items in a sequence from the item container according to the picking plan;

reading, by a plurality of code readers, an identification code of each picked item;

carrying, by a multi-axis robot, items that have not ready to be packing onto a buffer station in a packing round for temporary storage, when comparing the picking plan with the packing plan, so that the package cartons are packed according to the packing plan;

planning, by the controller, a filling path for a movable frame according to a coordinate data of gaps in the packing plan, in a case that the package carton is reserved with gaps according to the packing plan;

picking, by a first pick-up mechanism, void fill material dispensed from a void fill dispenser;

moving, by a movement mechanism, the first pick-up mechanism to a respective gap in the package carton according to the filling path;

releasing, by a first pick-up mechanism, the picked void fill material into a target gap; and pressing, by a pressing part under the driving of a compression mechanism, the void fill material further into the target gap.

According to some embodiments of the present application, after the compression mechanism further presses the void fill material into the target gap by moving the pressing part, the carton void filling method further includes:

picking, by the first pick-up mechanism, void fill material dispensed from the void fill dispenser;

moving, by the movement mechanism, the first pick-up mechanism to a filling opening of the package carton;

releasing, by the first pick-up mechanism, the picked void fill material into an inner top space of the package carton; and pressing, by the pressing part under the driving of the compression mechanism, the void fill material further into the inner top space of the package carton.

According to some embodiments of the present application, when the first pick-up mechanism picks up void fill material dispensed from the void fill dispenser, further includes:

dispensing, by the void fill dispenser, void fill material of a corresponding size and specification according to the packing plan.

Additional aspects and advantages of the present application will be partially given in the following description, and will become partially apparent from the following description, or be understood through the practice of the present application.

Figure 1:
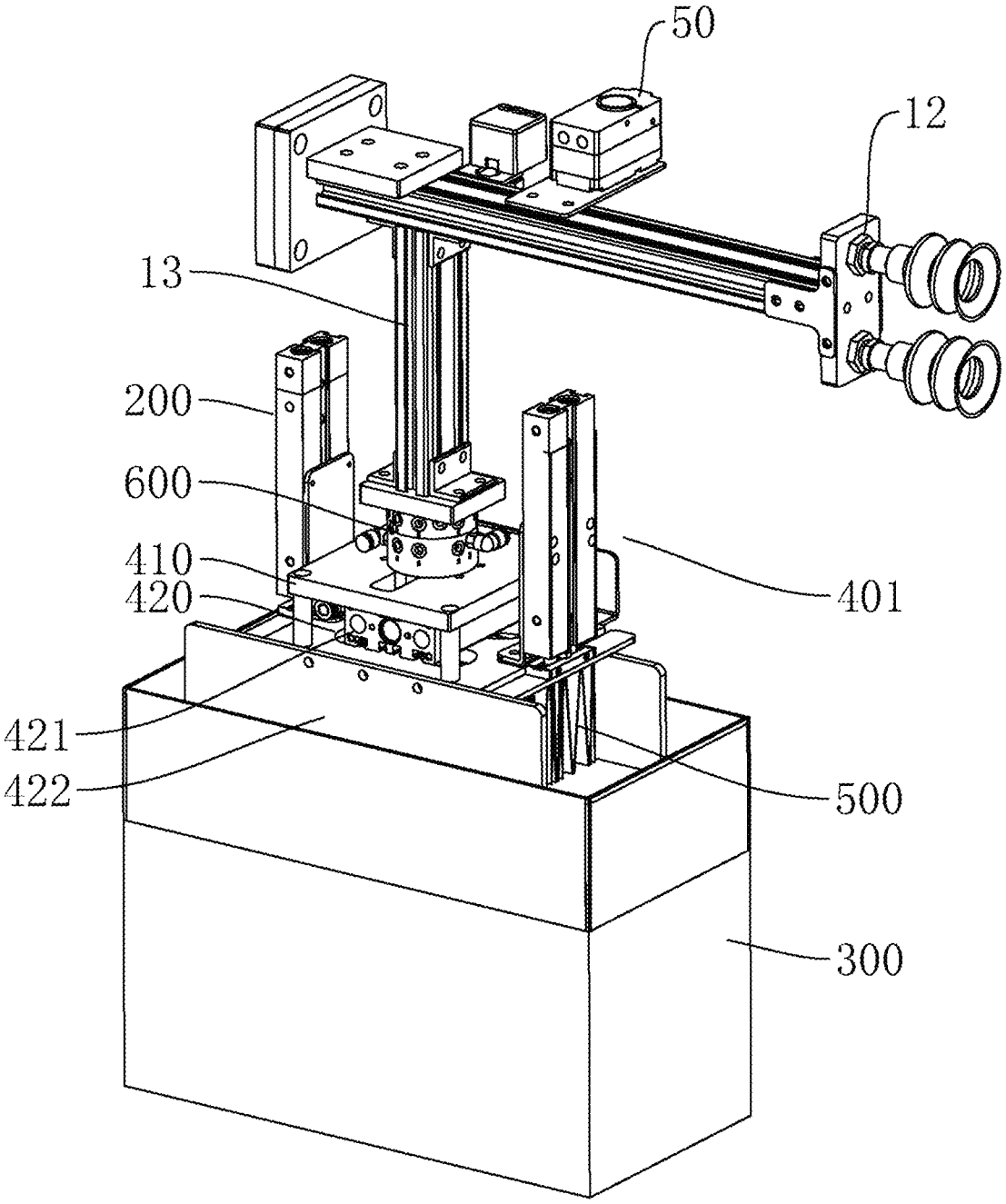
FIG. 1 is a schematic perspective structural view of a package carton void filling device according to an embodiment of the present application.

10 multi-axis robot, 11 execution unit, 12 second pick-up mechanism, 121 hollow structure, 13 movable frame;

20 pick-up station, 21 item container, 30 scanner, 40 visual probe, 50 code reader, 60 buffer station, 70 void fill dispenser, 71 paper discharging mechanism, 72 stacking mechanism, 80 packing station, 90 item;

100 first pick-up mechanism;

200 compression mechanism; 210 second actuation device, 220 pressing part, 211 second movable part, 221 pressing claw;

300 package carton, 310 long side gap, 320 wide side gap, 330 folding part;

401 long side pick-up mechanism, 402 wide side pick-up mechanism, 410 connection seat, 420 acquisition unit, 421 first actuation device, 422 clamping part, 423 first movable part, 424 clamping space;

500 filling paper; and

600 quick-release structure, 610 first quick-change fixture, 611 positioning pin, 620 second quick-change fixture, 621 positioning hole, 630 mechanical locking structure.

DETAILED DESCRIPTION OF EMBODIMENTS

The exemplary embodiments of the present application will be described in detail hereinafter, examples of which are illustrated in the accompanying drawings, where the same or similar reference numerals indicate the same or similar elements or elements having the same or similar functions throughout. The embodiments described below with reference to the accompanying drawings are exemplary and are only intended to explain the present application, but should not be construed as limiting the present application.

In the description of the present application, it should be noted that the orientation or positional relationship indicated by the terms top, bottom, front, back, left, right and the like is based on the orientation or positional relationship shown in the drawings, only for the convenience of describing the application and simplifying the description, and does not indicate or imply that the indicated device or element must have a specific orientation, or be constructed and operated in a specific orientation. Therefore, the terms should not be construed as limiting the present application.

In the description of the present application, terms such as "several", "greater than", "less than", "exceeding", "above", "below", and "within" may appear. Among these, "a plurality of" means one or more, and "multiple" means two or more; "greater than", "less than", and "exceeding" shall be construed as excluding the number itself, whereas "above", "below", and "within" shall be construed as including the number itself.

In the description of the present application, if there is a description term, e.g., first or second, it is only for the purpose of distinguishing technical features, and shall not be understood as indicating or implying relative importance, the number of the indicated technical features, and precedence relationship of the indicated technical features.

In the description of the present application, unless otherwise explicitly defined, words such as setting, installing and connecting should be understood in a broad sense, and those skilled in the art may reasonably determine the specific meanings of the above words in the present application in combination with the specific contents of the technical solutions.

Currently, in related technologies, during a packing process of a package carton 300, an operator needs to manually place void fill material into the inner top space of the package carton 300. The void fill material not only provides shock absorption, moisture resistance, and dustproof effect, but also fixes the items 90 in place in the package carton 300, reducing a risk of damage to the items 90 during transportation. However, this requires the operator to be constantly on duty. If the operator leaves his workstation for personal reasons, the subsequent carton sealing process is forced to halt.

After the introduction of mechanized equipment, related technologies may replace the operator's position with void fill dispenser. However, existing void fill dispenser may only place void fill material into the inner top space of the package carton 300. Gaps may still exist between the items 90 and the vertical inner walls of the package carton 300 or between the items 90 themselves. These gaps may also cause the items 90 to become loose during transportation, resulting in a risk that the items 90 in the package carton 300 may still be damaged due to collision.

It should be noted that the related technologies are only used to assist in understanding the technical solution of the present application and do not mean that they belong to the publicly known prior art.

A package carton void filling device, a packing assembly and a carton void filling method are provided in the present application, wherein the package carton gap filing device is provided to replace the operator. Specially, after obtaining a coordinate data of the gaps in the package carton 300, the package carton void filling device releases void fill material into a target gap through the first pick-up mechanism 100 and uses the compression mechanism 200 to further press the void fill material into the target gap, thereby filling the gaps between the items 90 and the vertical inner walls of the package carton 300 or between the items 90 themselves. This is conducive to fixing the position of the items 90 in the package carton 300, reducing the risk of the items 90 becoming loose during transportation, thereby effectively reducing the damage rate of items 90 in the logistics process and improving the quality of express delivery.

In addition, since the position of the gaps may exist on a long side or a wide side of the package carton 300, the first pick-up mechanism 100 is configured to be rotatable or replaceable to fill the long side gaps 310 or the wide side gaps 320 under various working conditions.

Figure 2:
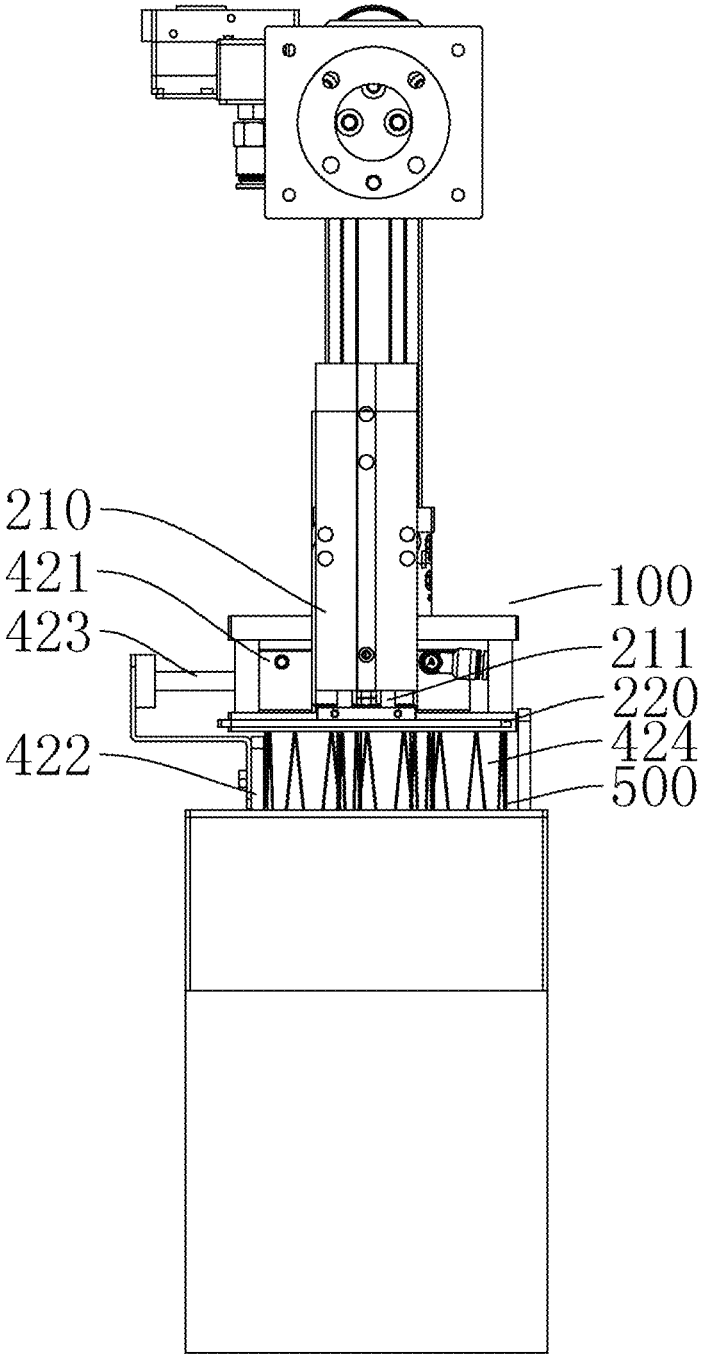
FIG. 2 is a side view of the package carton void filling device shown in FIG. 1.

As shown in FIGS. 1 and 2, a package carton void filling device according to an embodiment of the present application, includes a movement mechanism, a controller, a first pick-up mechanism 100, and a compression mechanism 200. Since the package carton void filling device needs to pick up void fill material dispensed from the void fill dispenser 70 and transfer the void fill material into the package carton 300, the movement mechanism is provided with a movable frame 13. The movable frame 13 moves along a filling path under the driving of the movement mechanism. The movement range of the movable frame 13 includes the void fill dispenser 70 and a position for filling the package carton 300.

Exemplarily, the movement mechanism includes, but is not limited to, a two-dimensional feeder, a three-dimensional feeder, or a multi-axis robot 10. A two-dimensional feeder has two degrees of freedom in the planar dimension, and a three-dimensional feeder has three degrees of freedom in the spatial dimension. Currently, a conventional multi-axis robot 10 is a five-axis or six-axis robot, but with technological development, the multi-axis robot 10 may also be a humanoid robot. When the multi-axis robot 10 is a six-axis robot, it has three rotational axis degrees of freedom (RX, RY, RZ) in addition to the three translational axis degrees of freedom (X, Y, Z), allowing an execution end of the six-axis robot to stop at any position within its range of motion to meet the technical requirements of automation.

Regardless of the structure of the movement mechanism, its movable frame 13 needs to be able to move back and forth between the void fill dispenser 70 and a position of filling the package carton 300, and the movement mechanism also needs the ability to position the movable frame 13 in the gaps of the package carton 300. To achieve the purpose of positioning the movable frame 13 in the gaps of the package carton 300, a controller of the package carton void filling device needs to plan a filling path for the movable frame 13 according to the gaps of the package carton 300. In this embodiment, the controller mainly obtains a coordinate data of the gaps within the package carton 300 through visual detection means or a preset packing plan. Once the coordinate data of the gaps in the package carton is obtained, the controller may control the operation of the movement mechanism based on this coordinate data, thereby positioning the movable frame 13 to a target gap, providing a technical foundation for subsequent gap filling.

In an embodiment, the first pick-up mechanism 100 includes a connection seat 410 and an acquisition unit 420. The connection seat 410 is connected to the movable frame 13, and the acquisition unit 420 is connected to the connection seat 410. The acquisition unit 420 has a first state and a second state. The acquisition unit 420 picks and places void fill material by switching between the first state and the second state. In this embodiment, when it is in the first state, the acquisition unit 420 maintains contact with the void fill material, that is, it is used to pick up and carry the void fill material; when the acquisition unit 420 is in the second state, it loses contact with the void fill material, meaning it is used to release the void fill material. Since the acquisition unit 420 is connected to the connection seat 410 and the connection seat 410 is connected to the movable frame 13, when the movement mechanism drives the movable frame 13 to position itself at the target gap in the package carton 300, the acquisition unit 420 is also positioned at the target gap. If the acquisition unit 420 was already in the first state before moving, it may switch from the first state to the second state after being positioned, thereby releasing the void fill material into the target gap.

Various types of void fill materials, such as filling paper 500, foam, or wood chips, may be used in this application. The acquisition unit 420 has different structures for different types of void fill materials. Taking filling paper 500 as an example, it is a commonly used environmentally friendly void fill material, mainly made from waste paper, wood pulp and the like, which is derived from renewable plant fibers. The filling paper 500 is produced by a paper discharging mechanism 71. The paper discharging mechanism 71 is fed with a continuous paper stack, and kneads and cuts the supplied paper into filling paper 500 of a specific length through kneading and cutting components. The produced filling paper 500 is stacked by a stacking mechanism 72. Since the filling paper 500 is stacked in a compressible way, filling paper 500 of a specified length but indefinite thickness may be obtained through the void fill dispenser 70 composed of the paper discharging mechanism 71 and the stacking mechanism 72.

In order to be able to pick and release filling paper 500, the acquisition unit 420 includes a first actuation device 421 and two clamping parts 422. The first actuation device 421 is connected to the connection seat 410. In an embodiment, the first actuation device 421 may be a cylinder. The first actuation device 421 is provided with a retractable first movable part 423. The first actuation device 421 is connected to at least one clamping part 422 through the first movable part 423. If the first actuation device 421 is connected to one of clamping parts 422 via the first movable part 423, then another clamping part 422 not connected to the first movable part 423 needs to be fixedly connected to the connection seat 410. The two clamping parts 422 are arranged parallel to each other, forming a clamping space 424 between them. The first actuation device 421 adjusts an opening width of the clamping space 424 by changing the relative positions of the two clamping parts 422, thereby achieving clamping or releasing of the filling paper 500. Alternatively, the two clamping parts 422 are not parallel but are hinged together via a hinge component. In this case, a clamping space 424 is also formed between the two clamping parts 422, and the first actuation device 421 adjusts an opening width of the clamping space 424 by changing the relative positions of the two clamping parts 422, thereby achieving clamping or releasing of the filling paper 500.

If the first actuation device 421 is connected to both clamping parts 422 via the first movable part 423, then the first actuation device 421 may be a double-acting cylinder, which is provided with two first movable parts 423. The two first movable parts 423 have a movement path for synchronous extension or synchronous retraction. The two first movable parts 423 are connected to the two clamping parts 422 respectively, achieving synchronous extension or retraction of the two clamping parts 422. When the two clamping parts 422 are controlled to synchronously retract, the acquisition unit 420 switches from the second state to the first state. When the two clamping parts 422 are controlled to synchronously extend, the acquisition unit 420 switches from the first state to the second state.

In summary, the void fill dispenser 70 produces filling paper 500 of a corresponding size according to the gap size in the package carton 300. The movement mechanism drives the acquisition unit 420 to move to the filling paper 500. The acquisition unit 420 switches from the second state to the first state to clamp the filling paper 500. Subsequently, under the control of the controller, the movement mechanism drives the acquisition unit 420 to move to a target gap in the package carton 300. The acquisition unit 420 switches from the first state to the second state to release the filling paper 500 into the target gap, thereby preliminarily filling the target gap.

Furthermore, since the thickness of the filling paper 500 is variable, to prevent the filling paper 500 from being unable to fall into the target gap due to excessive thickness when released onto it, the acquisition unit 420 may adjust the opening width of the clamping space 424 according to the gap size of the package carton 300. Since the thickness of the filling paper 500 is positively correlated with the opening width of the clamping space 424, this scheme may be used to adjust the thickness of the filling paper 500 so that it is less than a width of the target gap, ensuring that the filling paper 500 may smoothly fall into the target gap when released.

In addition, there is a simpler way to adjust the thickness of the filling paper 500: whenever the acquisition unit 420 clamps the filling paper 500, the first actuation device 421 adjusts the opening width of the clamping space 424 toward its minimum value. Although the filling paper 500 has an uncertain thickness, it still has a minimum thickness. Once the filling paper 500 is gripped to its minimum thickness, the first actuation device 421 may no longer adjust the opening width of the clamping space 424. At this point, the thickness of the filling paper 500 is guaranteed to be less than a width of the target gap.

Figure 6:
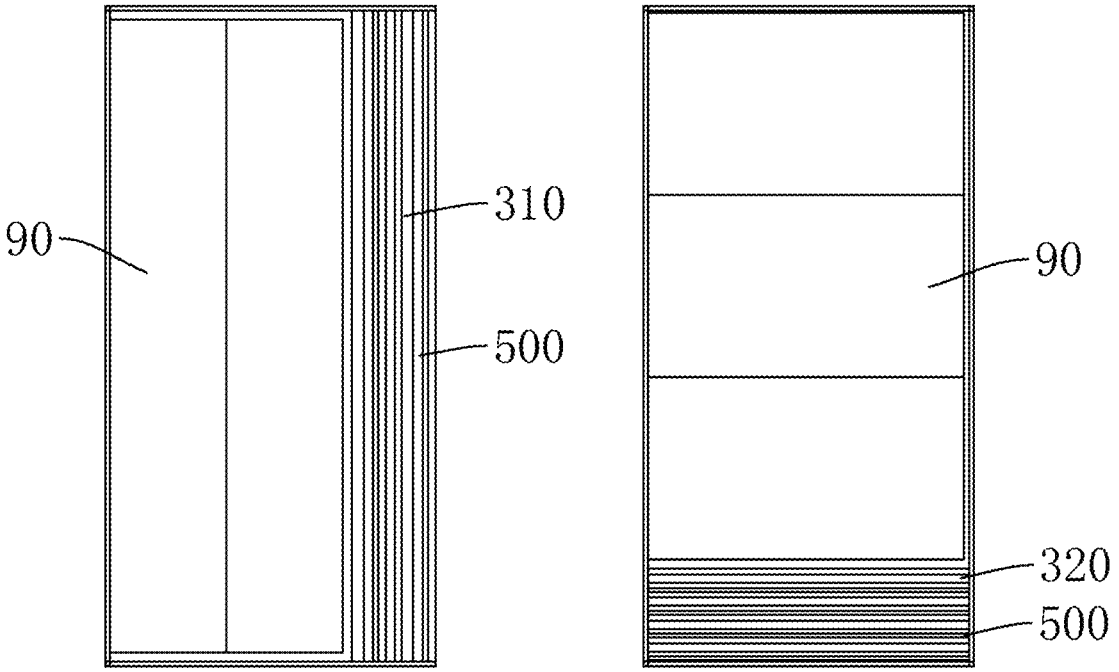
FIG. 6 is a schematic structural view of a package carton with a long side gap and a wide side gap being filled respectively according to an embodiment of the present application.

As shown in FIG. 6, for a rectangular package carton 300, since the package carton 300 has long sides and wide sides, its gaps also include long side gaps 310 and wide side gaps 320. Since a long side gap 310 and a wide side gap 320 maintain an angle of 90° between them, the clamping direction of the acquisition unit 420 needs to be changed to accommodate the filling of either the long side gap 310 or the wide side gap 320. To this end, a rotation mechanism is provided between the movement mechanism and the movable frame 13, or between the movable frame 13 and the connection seat 410. The rotation mechanism has a rotation axis arranged along the first direction. In an embodiment, the first direction refers to the direction perpendicular to the bottom surface of the package carton 300, i.e., the depth direction of the package carton 300.

If the movement mechanism is selected as a six-axis robot, the rotation mechanism may be considered as one of its rotating joints. The six-axis robot changes the clamping direction of the acquisition unit 420 by rotating the joint. Alternatively, the movable frame 13 and the connection seat 410 are connected via a rotation mechanism. The rotation mechanism includes a rotation motor and a rotation plate. The rotation motor and the rotation plate are connected to the movable frame 13 and the connection seat 410 respectively. The rotation motor may drive the rotation plate to rotate around the first direction. Under the premise that the position of the movable frame 13 remains fixed, the connection seat 410 may change the clamping direction of the acquisition unit 420 through the rotation mechanism.

Combining the above structure, if the package carton 300 has both a long side gap 310 and a wide side gap 320, then the void fill dispenser 70 produces filling paper 500 of a corresponding size according to the size of the long side gap 310. The movement mechanism drives the acquisition unit 420 to move to the filling paper 500, and the acquisition unit 420 switches from the second state to the first state, so as to clamp the filling paper 500. Subsequently, under the control of the controller, the movement mechanism drives the acquisition unit 420 to move to the long side gap 310 of the package carton 300, and the acquisition unit 420 switches from the first state to the second state, so as to release the filling paper 500 into the long side gap 310, thereby preliminarily filling the long side gap 310. After this, the void fill dispenser 70 produces filling paper 500 of a corresponding size according to the size of the wide side gap 320. The movement mechanism drives the acquisition unit 420 to move to the filling paper 500, and the acquisition unit 420 switches from the second state to the first state, so as to clamp the filling paper 500. Subsequently, under the control of the controller, the movement mechanism drives the acquisition unit 420 to move to the wide side gap 320 of the package carton 300. During this process, the rotation mechanism drives the acquisition unit 420 to rotate 90°. The acquisition unit 420 switches from the first state to the second state to release the filling paper 500 into the wide side gap 320, thereby preliminarily filling the wide side gap 320.

Figure 3:
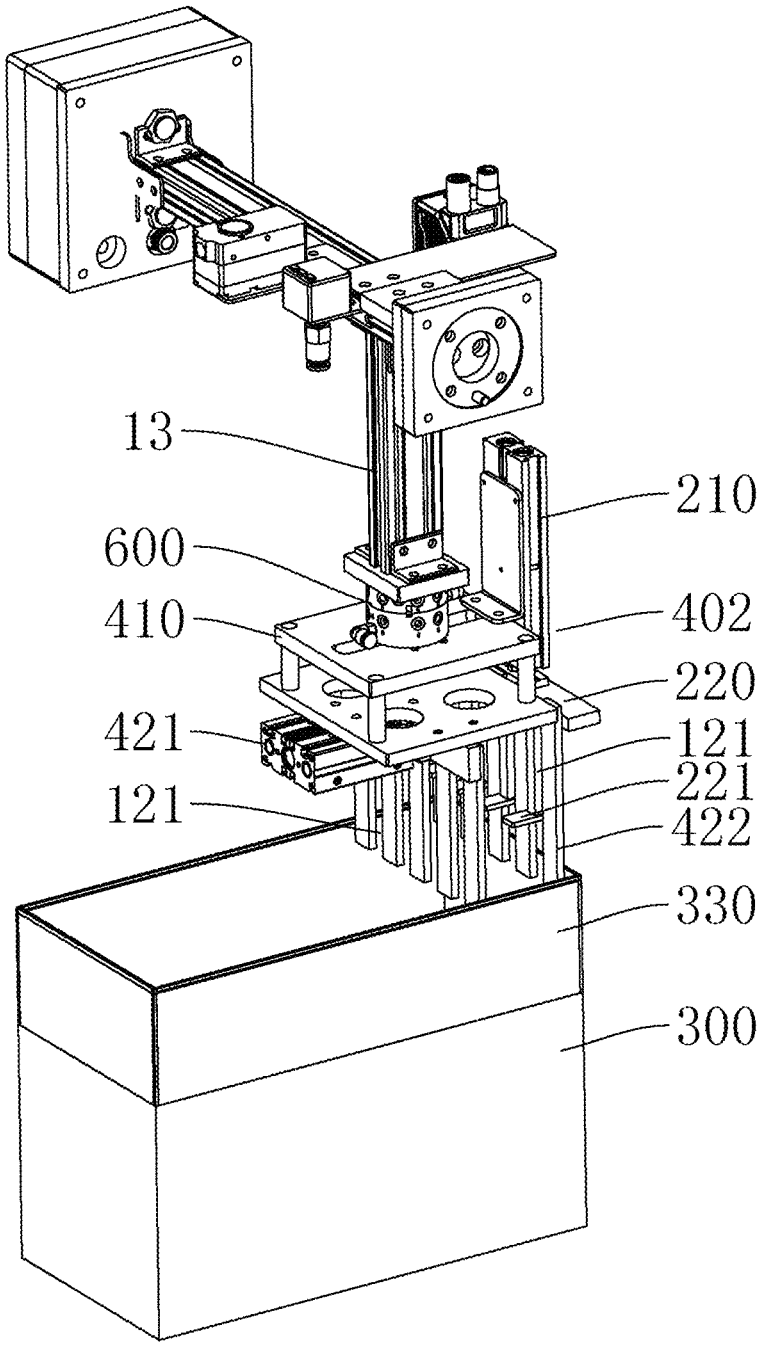
FIG. 3 is a schematic perspective structural view of a package carton void filling device according to an embodiment of the present application when used for a gap of wide side.
Figure 4:
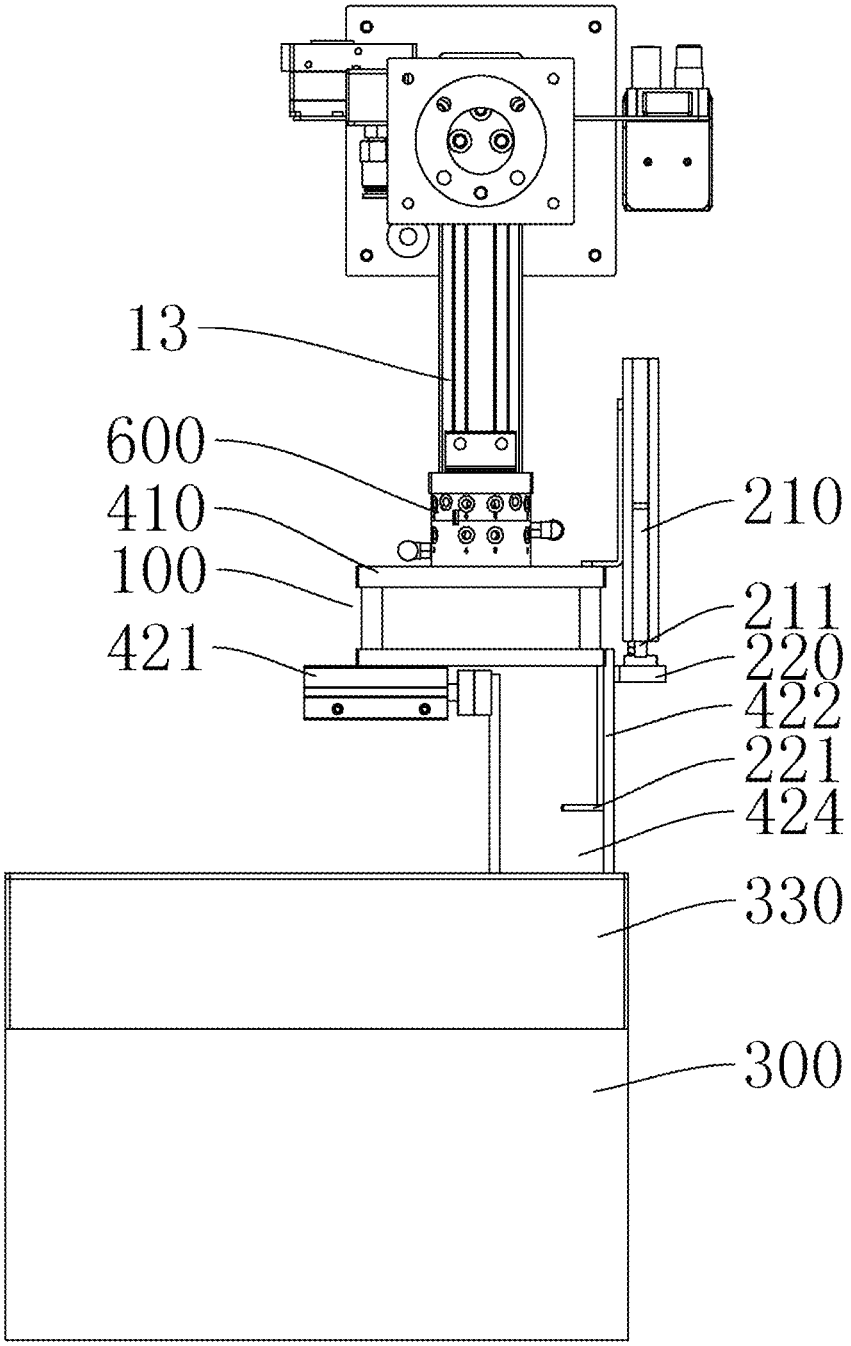
FIG. 4 is a front view of the package carton void filling device shown in FIG. 3.

As shown in FIGS. 1, 3 and 6, the length of the clamping part 422 may be designed according to a length of the target gap to prevent the filling paper 500 from excessively extending beyond the clamping space 424, reducing the probability of interference between the filling paper 500 and the items 90 during filling. If the length of the clamping part 422 is set too short, the filling paper 500 will extend significantly beyond the clamping parts 422. Since the filling paper 500 is a flexible structure, the thickness of the extended part is not constrained by the two clamping parts 422, which may cause interference with the items 90 during filling, preventing the filling paper 500 from smoothly falling into the target gap.

For a long side gap 310, the length of the clamping part 422 should be substantially equal to the length of the long side gap 310. For a short side gap, the length of the clamping part 422 should be substantially equal to the length of the short side gap. In view of this, if the long side gap 310 of the package carton 300 is twice or more the length of the wide side gap 320, it is preferred to prepare two first pick-up mechanisms 100, one of which is defined as a long side pick-up mechanism 401 and the other is defined as a wide side pick-up mechanism 402. The long side pick-up mechanism 401 is used to fill filling paper 500 into the long side gap 310, and the wide side pick-up mechanism 402 is used to fill filling paper 500 into the wide side gap 320. The connection seat 410 of any one of first pick-up mechanisms 100 is connected to the movable frame 13 through a quick-release structure 600. The two first pick-up mechanisms 100 have clamping parts 422 of different lengths. The length of the clamping parts 422 of the long side pick-up mechanism 401 is substantially equal to the length of the long side gap 310, and the length of the clamping parts 422 of the wide side pick-up mechanism 402 is substantially equal to the length of the wide side gap 320.

Since the package carton 300 come in various sizes and specifications, to meet the gap filling needs of different package cartons 300, the number of first pick-up mechanisms 100 may be three, four, etc., and each first pick-up mechanism 100 has clamping parts 422 of a certain length.

Figure 5:
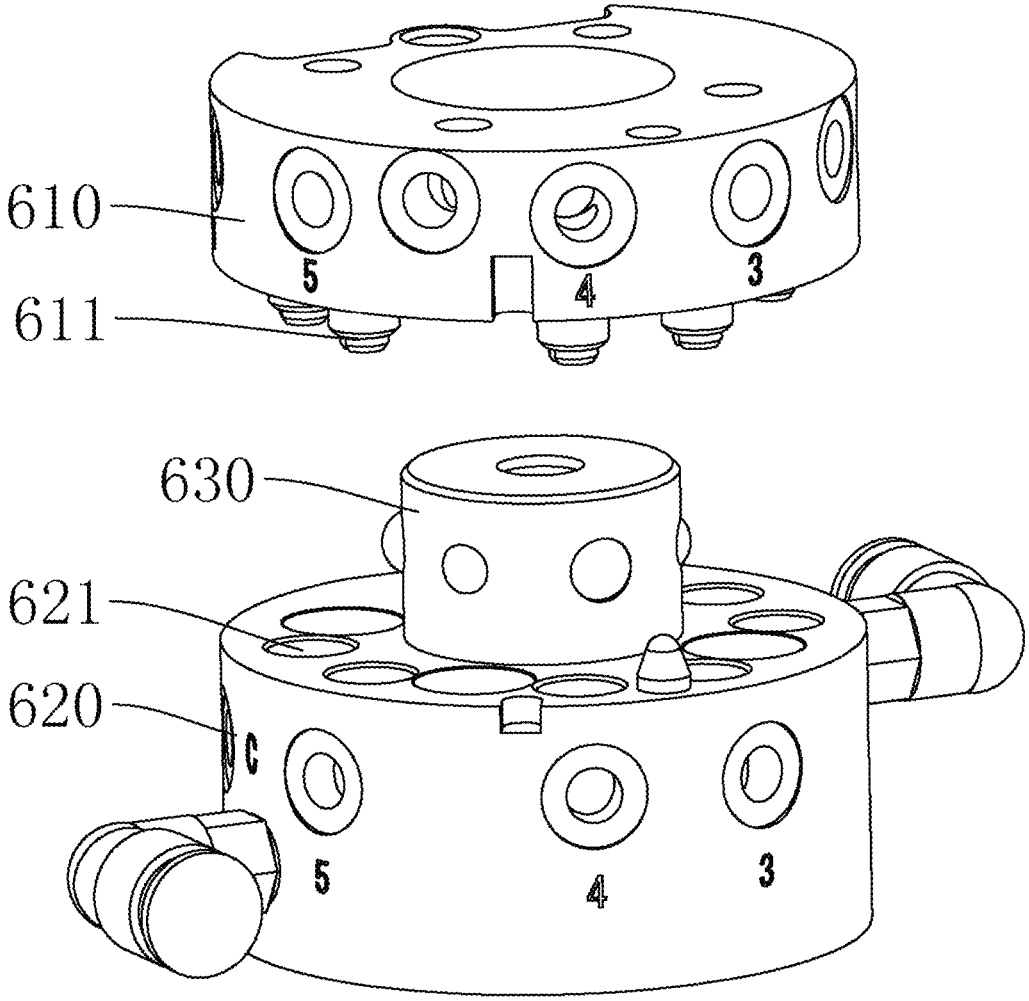
FIG. 5 is a schematic perspective structural view of a quick-release structure according to an embodiment of the present application.

Among them, the quick-release structure 600 is shown in FIG. 5. It includes a first quick-change fixture 610 and a second quick-change fixture 620. The first quick-change fixture 610 is fixedly connected to the movable frame 13. The connection seats 410 of the two first pick-up mechanisms 100 are both fixedly connected with second quick-change fixtures 620 of the same specification. One of the first quick-change fixture 610 and the second quick-change fixture 620 is provided with a plurality of positioning holes 621, and the other is accordingly provided with positioning pins 611 that match the positioning holes 621 in one-to-one relationship. After the first quick-change fixture 610 and the second quick-change fixture 620 are aligned through the multiple positioning pins 611 and positioning holes 621, they are firmly locked together by an internal mechanical locking structure 630 (such as a spring-loaded pin, a pneumatic latch, or an electromagnetic lock) to ensure they do not fall off during movement.

During use, the movable frame 13 is connected to any one of first pick-up mechanisms 100 to fill the gap in the package carton. When the type of target gap changes, the movement mechanism drives the movable frame 13 to move to a fixture station, which may engage with the first pick-up mechanism 100, so that the first pick-up mechanism 100 is allowed to be disassembled in a whole by the movable frame 13. Then, the movement mechanism drives the movable frame 13 to move to another fixture station and assembles with another first pick-up mechanism 100 on it, thus achieving the replacement of different first pick-up mechanisms 100.

Combining the above structure, if the package carton 300 has both a long side gap 310 and a wide side gap 320, then the void fill dispenser 70 dispenses void fill paper 500 of a corresponding size according to the size of the long side gap 310. The movement mechanism drives the long side pick-up mechanism 401 to move to the filling paper 500, and the acquisition unit 420 of the long side pick-up mechanism 401 switches from the second state, so as to the first state to clamp the filling paper 500. Subsequently, under the control of the controller, the movement mechanism drives the long side pick-up mechanism 401 to move to the long side gap 310 of the package carton 300, and the acquisition unit 420 of the long side pick-up mechanism 401 switches from the first state to the second state, so as to release the filling paper 500 into the long side gap 310, thereby preliminarily filling the long side gap 310. After this, the movement mechanism controls the movable frame 13 to disassemble the long side pick-up mechanism 401 via the quick-release structure 600 and reassemble the wide side pick-up mechanism 402. The void fill dispenser 70 produces filling paper 500 of a corresponding size according to the size of the wide side gap 320. The movement mechanism drives the wide side pick-up mechanism 402 to move to the filling paper 500, and the acquisition unit 420 of the wide side pick-up mechanism 402 switches from the second state to the first state, so as to clamp the filling paper 500. Subsequently, under the control of the controller, the movement mechanism drives the wide side pick-up mechanism 402 to move to the wide side gap 320 of the package carton 300. During this process, the rotation mechanism on the movement mechanism drives the wide side pick-up mechanism 402 to rotate 90°. The acquisition unit 420 of the wide side pick-up mechanism 402 switches from the first state to the second state to release the filling paper 500 into the wide side gap 320, thereby preliminarily filling the wide side gap 320.

In a case that the void fill material is foam, in addition to clamping the foam using the above structure, the acquisition unit 420 may also suck the foam through a negative pressure adsorption component. Specifically, the acquisition unit 420 is provided with a negative pressure adsorption component. In this embodiment, the negative pressure adsorption component may be a negative pressure suction cup. The negative pressure adsorption component is connected with a negative pressure channel, and a control valve is provided on the negative pressure channel. When the control valve opens the negative pressure channel, the negative pressure adsorption component generates a negative pressure suction force. At this time, the acquisition unit 420 is in the first state and sucks the foam from the void fill dispenser 70 through the negative pressure adsorption component. When the control valve closes the negative pressure channel, the negative pressure adsorption component loses negative pressure suction force. At this time, the acquisition unit 420 is in the second state and releases the sucked foam through the negative pressure adsorption component.

For a rectangular package carton 300, since the package carton 300 has long sides and wide sides, that is, it includes a long side gap 310 and a wide side gap 320. If the void fill dispenser 70 has a unique production direction when producing foam, the direction of the foam on the acquisition unit 420 needs to be changed to meet the filling of the long side gap 310 and the wide side gap 320. To this end, a rotation mechanism is provided between the movement mechanism and the movable frame 13, or between the movable frame 13 and the connection seat 410. The rotation mechanism has a rotation axis arranged along the first direction.

Combining the above structure, if the package carton 300 has both a long side gap 310 and a wide side gap 320, then the void fill dispenser 70 produces foam of a corresponding size according to the size of the long side gap 310. The movement mechanism drives the acquisition unit 420 to move to the foam, and the acquisition unit 420 switches from the second state to the first state, so as to suck the foam. Subsequently, under the control of the controller, the movement mechanism drives the acquisition unit 420 to move to the long side gap 310 of the package carton 300, and the acquisition unit 420 switches from the first state to the second state, so as to release the foam into the long side gap 310, thereby preliminarily filling the long side gap 310. After this, the void fill dispenser 70 produces foam of a corresponding size according to the size of the wide side gap 320. The movement mechanism drives the acquisition unit 420 to move to the foam, and the acquisition unit 420 switches from the second state to the first state, so as to suck the foam. Subsequently, under the control of the controller, the movement mechanism drives the acquisition unit 420 to move to the wide side gap 320 of the package carton 300. During this process, the rotation mechanism drives the acquisition unit 420 to rotate 90°. The acquisition unit 420 switches from the first state to the second state to release the foam into the wide side gap 320, thereby preliminarily filling the wide side gap 320.

As shown in FIGS. 1 to 4, after the first pick-up mechanism 100 fills the void fill material into the target gap in the package carton 300, to further press the void fill material into the target gap, a compression mechanism 200 is also connected with the connection seat 410 beside the acquisition unit 420. The compression mechanism 200 includes a second actuation device 210 and a pressing part 220. The second actuation device 210 is connected to the connection seat 410. In this embodiment, the second actuation device 210 may be optionally cylinder. The second actuation device 210 is provided with a retractable second movable part 211. The second movable part 211 is connected to the pressing part 220. The second actuation device 210 drives the pressing part 220 to move along the first direction, so that the pressing part 220 has a movement path along the first direction under the driving of the compression mechanism 200. The execution sequence of the compression mechanism 200 comes after that of the first pick-up mechanism 100. That is, only after the first pick-up mechanism 100 fills the void fill material into the gap or the inner top space of the package carton 300 does the compression mechanism 200 perform the pressing action, thereby compacting the void fill material in the depth direction of the package carton 300, which helps fix the position of the items 90 in the package carton 300.

It should be noted that for the long side pick-up mechanism 401, since the clamping parts 422 are longer, a compression mechanism 200 may be provided on each side of the clamping parts 422 to balance the force applied to the void fill material during pressing, preventing the void fill material from warping during the compaction process. For the wide side pick-up mechanism 402, since the clamping parts 422 are shorter, only one compression mechanism 200 needs to be provided on either side of the clamping parts 422. Since the compression mechanism 200 might interfere with the folding part 330 of the package carton 300 due to limited space, both clamping parts 422 themselves are arranged with a hollow structure 121. The pressing part 220 of the compression mechanism 200 is connected with a pressing claw 221. The pressing claw 221 is located on the hollow structure 121 of one of clamping parts 422, allowing the pressing part 220 to press down on the void fill material through the pressing claw 221. The setting of the hollow structure 121 ensures that the movement of the pressing claw 221 is not affected by the clamping part 422, thus separating the pressing part 220 from the folding part 330 of the package carton 300 to avoid interference.

Combining the above structure, if the package carton 300 has both a long side gap 310 and a wide side gap 320, then the void fill dispenser 70 produces void fill material of a corresponding size according to the size of the long side gap 310. The movement mechanism drives the long side pick-up mechanism 401 to move to the void fill material, and the acquisition unit 420 of the long side pick-up mechanism 401 switches from the second state to the first state, so as to pick up the void fill material. Subsequently, under the control of the controller, the movement mechanism drives the long side pick-up mechanism 401 to move to the long side gap 310 of the package carton 300, and the acquisition unit 420 of the long side pick-up mechanism 401 switches from the first state to the second state, so as to release the void fill material into the long side gap 310. Finally, the second actuation devices 210 of the two compression mechanisms 200 drive the pressing parts 220 to further press the void fill material into the target gap. After this, the movement mechanism controls the movable frame 13 to disassemble the long side pick-up mechanism 401 via the quick-release structure 600 and reassemble the wide side pick-up mechanism 402. The void fill dispenser 70 produces void fill material of a corresponding size according to the size of the wide side gap 320. The movement mechanism drives the wide side pick-up mechanism 402 to move to the void fill material, and the acquisition unit 420 of the wide side pick-up mechanism 402 switches from the second state to the first state, so as to pick up the void fill material. Subsequently, under the control of the controller, the movement mechanism drives the wide side pick-up mechanism 402 to move to the wide side gap 320 of the package carton 300. During this process, the rotation mechanism on the movement mechanism drives the wide side pick-up mechanism 402 to rotate 90°. The acquisition unit 420 of the wide side pick-up mechanism 402 switches from the first state to the second state to release the void fill material into the wide side gap 320. Finally, the second actuation device 210 of the compression mechanism 200 drives the pressing part 220 to further press the void fill material into the target gap.

It is understandable that the compression mechanism 200 also exists in the first pick-up mechanism 100 equipped with a negative pressure adsorption component. Regardless of the structure of the first pick-up mechanism 100, the compression mechanism 200 is connected to the connection seat 410 and located beside the acquisition unit 420.

It should be further noted that since the package carton void filling device is provided with a compression mechanism 200 designed to press the void fill material into the gaps in the package carton 300. This configuration is particularly advantageous in special packaging scenarios, such as when the package carton 300 are loaded horizontally rather than from the top. In such cases, the compression mechanism 200 effectively prevents the void fill material from falling out of the target gap due to gravity by ensuring it is securely pressed into place from the side.

In some embodiments of the present application, to obtain the coordinate data of the gaps in the package carton 300, the package carton void filling device further includes a visual detection unit. The visual detection unit faces and detects the interior of the package carton 300 directly. The visual detection unit may selectively use technologies such as structured light scanning, binocular stereo vision, or lidar. When using structured light scanning, the instrument projects encoded fringe structured light into the interior of the package carton 300 and obtains 3D point cloud data through phase calculation to accurately locate an associated coordinate of the gaps. When using binocular stereo vision, two cameras capture images of the interior of the package carton 300 from different angles, and use a stereo matching algorithm to calculate the 3D coordinates of pixels to accurately locate an associated coordinate of the gaps. When using lidar, the instrument emits a laser beam to measure a reflection time period, directly obtaining depth information of the inner surface of the package carton 300 to quickly locate an associated coordinate of the gaps.

That is, the controller obtains the coordinate data of the gaps within the package carton 300 through the visual detection unit. Then, the controller controls the operation of the movement mechanism based on the obtained coordinate data, giving the movable frame 13 a filling path that allows it to locate the target gap. Although the controller may obtain the coordinate data of the gaps within the package carton 300, a visual detection unit is necessary in this scheme. The following describes an alternative scheme that does not rely on a visual detection unit.

Figure 7:
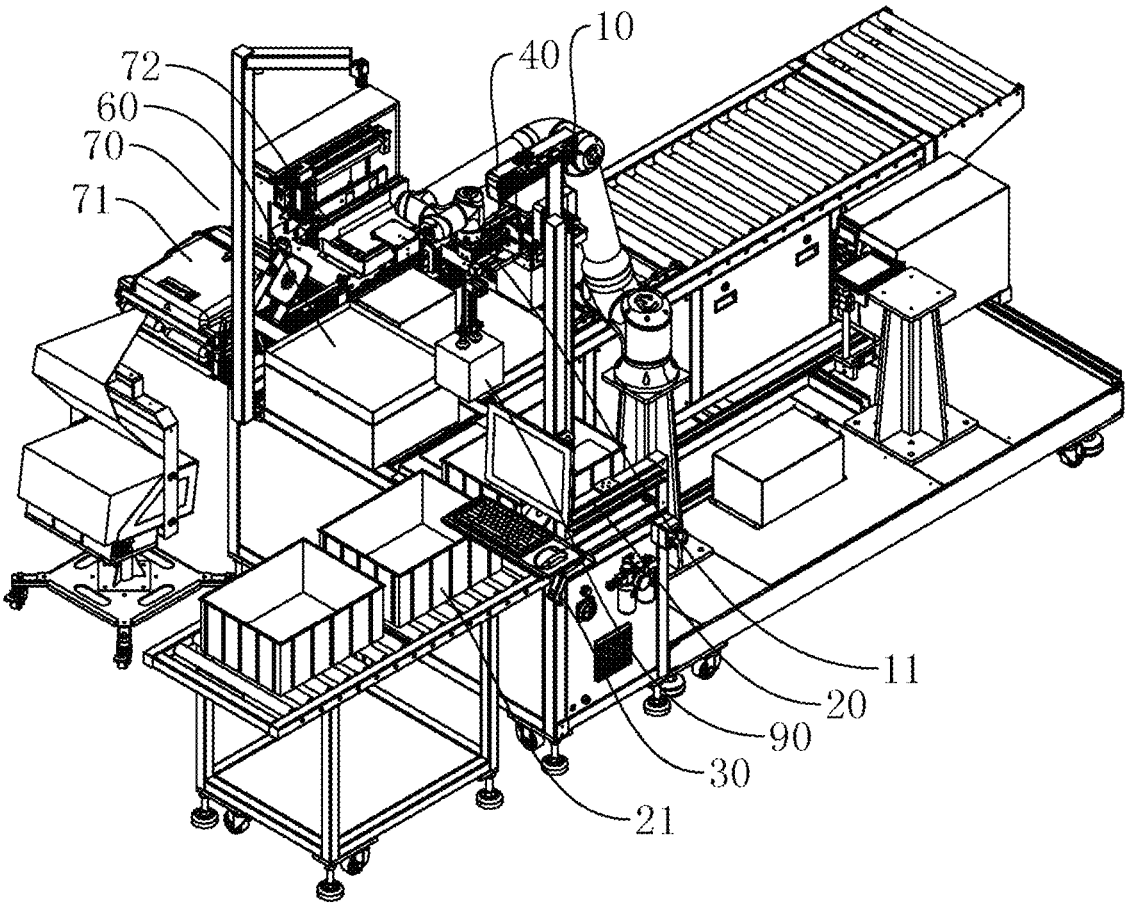
FIG. 7 is a schematic perspective structural view of a packing assembly from a first viewing angle according to an embodiment of the present application.
Figure 8:
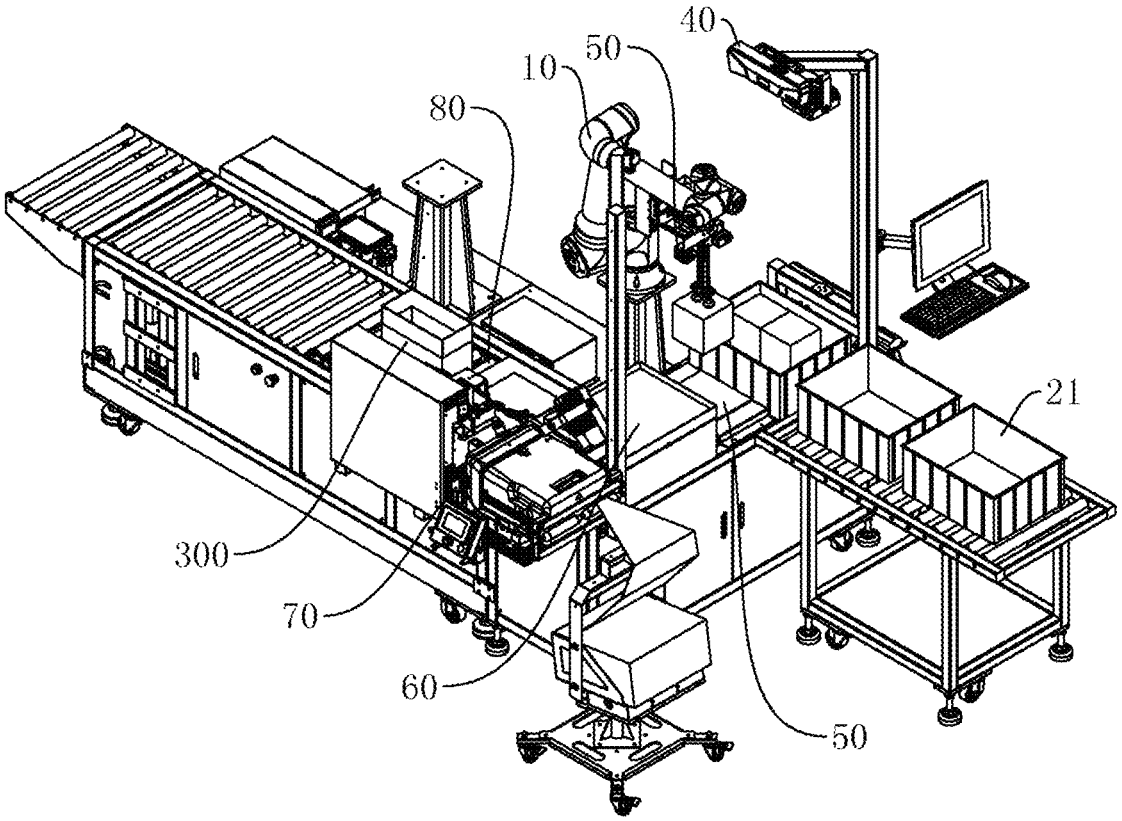
FIG. 8 is a schematic perspective structural view of the packing assembly from a second viewing angle according to an embodiment of the present application.

As shown in FIGS. 7 and 8, an embodiment of the present application provides a packing assembly. The packing assembly includes a multi-axis robot 10, a pick-up station 20, a plurality of scanners 30, a plurality of visual probes 40, a plurality of code readers 50, a buffer station 60, a void fill dispenser 70, and a packing station 80. The pick-up station 20 is used for placing an item container 21 containing items 90 to be picked. The packing station 80 is used for storing a package carton 300 waiting to be filled. The multi-axis robot 10 is provided with an execution unit 11. The movement range of the execution unit 11 includes the pick-up station 20, the buffer station 60, and the packing station 80. The execution unit 11 is provided with a second pick-up mechanism 12 for picking and carrying items 90. The pick-up means of the second pick-up mechanism 12 includes, but is not limited to, a negative pressure adsorption component, a clamp component, or a hook component.

The scanner 30 may be a scanning gun. After the scanners 30 scan the information code of the item container 21, the controller of the packing assembly obtains the product parameters of all items 90 in the item container 21 based on the information code. The controller first determines a specification that allows a package carton 400 to accommodate all items 90 based on the product parameters of all items 90 in the item container 21. After determining the specification of the package carton 400, the controller calls a packing model based on the product parameters of all items 90 and generates a packing plan based on the packing model. For example, if there are three items, including item a, item b and item c, the optimal packing plan might be to place item b on the bottom of the package carton 400 first, then place item c on top of item b, and finally place item a in a spared space next to item c.

In an embodiment of the present application, the packing model needs to be trained before it is put into use to adjust its internal parameters so as to achieve a better packing result. Specifically, when training the model, a batch of packing data may be acquired. Each packing data includes several items 90 to be packed, and a true label corresponding to the packing data is obtained. The true label is used to characterize a respective candidate placement position of each item 90 within the package carton 400 and an associated true placement score of each item 90 at the candidate placement position. Then, each packing data and its corresponding true label may be used as a set of training data. The input data of the model is the packing data. The model predicts and generates a packing plan based on the packing data, that is, a predicted packing plan is output by the model. This predicted packing plan includes each predicted placement position of the items 90 within the package carton 400 output by the model and a respective predicted score at each predicted placement position. After obtaining the predicted packing plan output by the model, the accuracy of the model prediction may be evaluated based on the predicted packing plan and the true label, thereby updating the parameters of the model.

Specifically, for the packing model, the accuracy of its predictions may be measured by the consistency between the predicted packing plan and the true label. The closer the predicted packing plan is to the true label, the more accurate and reliable the predicted packing plan is. Conversely, the less close they are, the less accurate and reliable the predicted packing plan generated by the model is. Therefore, in the embodiments of the present application, a target loss value may be determined based on the predicted packing plan and the true label. The loss function used to determine the target loss value is not limited in the present application. For example, any one of the MSE loss function, 0-1 loss function, classification placement action (CrossEntropy) loss function, sorting optimization (Ranking Loss e.g., ListNet) loss function, absolute loss function, or a combination of multiple loss functions may be used.

The target loss value may be used to train the packing model. Specifically, the relevant parameters of the packing model may be updated through a back-propagation algorithm to improve the performance of the packing model. In an embodiment of the present application, the training method may be performed in a cyclic iterative manner, that is, the parameters of the packing may be updated round by round. For example, multiple sets of training data may be acquired. Each set includes packing data and a corresponding true label. Then, the one of training data sets may be used to calculate a corresponding target loss value and thus the parameters of the packing model are updated in one round. Then, based on the updated packing model, use the data of another training set to calculate another corresponding target loss value and continue updating the parameters for another round. In this way, a trained packing model is obtained by iterative loop. Here, a specific condition for determining the end of training may be set according to actual needs. For example, in some embodiments, a target number of training iterations may be set. The iteration is counted and recorded during training, and each time the model parameters are updated, the counted iteration increases by 1. If the counted iteration reaches the target number after updating the parameters, the training may be considered finished, yielding the trained packing model. If the counted iteration has not reached the target number after updating, iterative training continues. In some embodiments, a test data set may also be acquired to test the prediction accuracy of the predicted packing plan generated by the packing model. Each time the model parameters are updated, a test is performed using the test dataset. If the prediction accuracy obtained from the test meets a pre-set requirement after updating the parameters, the training may be considered finished, yielding the trained packing model. If the prediction accuracy does not meet the requirement after updating, iterative training continues. It should be understood that the above embodiments are only exemplary descriptions of the process for training the packing model in the present application and do not imply limitations on its specific implementation.

The visual probe 40 may be a 3D camera. After the visual probes 40 capture images of the items 90 in the item container 21, the controller generates a picking plan. The execution unit 11 of the multi-axis robot 10 is configured to sequentially retrieve the items 90 from the item container 21 according to the picking plan. Taking the three items as an example, such as item a, item b and item c, if item a is stacked on top of item c, and item c is stacked on top of item b, then according to the principle of top-down retrieval, the picking plan would be to pick item a first, then item c, and finally item b. The code reader 50 may be a code reading camera. Each time an item 90 is picked, the code readers 50 read its identification code. By comparing the picking plan with the packing plan, the controller controls the multi-axis robot 10 to carry items 90 that are not in their turn for packing and temporarily store them onto the buffer station 60, so that the package carton 300 is packed according to the packing plan.

After the package carton 300 is packed, void fill material is needed to fill the internal gap space. The void fill dispenser 70 is used to produce void fill material. It produces void fill material of specified specifications according to the packing plan. If gaps exist between the items 90 and the vertical inner walls of the package carton 300 or between the items 90 themselves according to the packing plan, since the gaps of the package carton 300 are generated according to the packing plan, their coordinate data is known. In this case, the controller may plan a filling path for the movable frame 13 according to the packing plan, thereby eliminating the need for the visual detection unit.

Since the movement mechanism of the package carton void filling device may be a six-axis robot, and the packing assembly also has a multi-axis robot 10, this embodiment uses the multi-axis robot 10 of the packing assembly as the movement mechanism of the package carton void filling device. In this case, the movement range of the execution unit 11 also includes the void fill dispenser 70. The execution unit 11 is simultaneously provided with a second pick-up mechanism 12 and the first pick-up mechanism 100, both of which are connected to the movable frame 13 in different orientations. The execution unit 11 activates the first pick-up mechanism 100 or the second pick-up mechanism 12 by rotating the movable frame 13.

In other embodiments, even if the controller of the packing assembly may generate the packing plan, a visual detection unit may still be set at the packing position of the package carton 300. At this time, the main function of the visual detection unit is to correct the coordinate data of the gaps in the package carton 300 in the packing plan and provide evaluation for the practice of the packing model.

It should be further noted that since the long side gap 310 of the package carton 300 has the same length as the inner top space of the package carton 300, the package carton void filling device may directly fill the inner top space of the package carton 300 after filling the long side gap 310. Therefore, the packing plan of the packing assembly should be designed to minimize the simultaneous occurrence of long side gaps 310 and wide side gaps 320. Once both long side gaps 310 and wide side gaps 320 appear simultaneously in the package carton 300, it will affect the filling efficiency because the process of rotating the first pick-up mechanism 100 or replacing the first pick-up mechanism 100 is involved during filling.

It is worth noting that the packing assembly is suitable for packing various types of items 90, including items 90 of various shapes (regular or irregular), and may also use package cartons 300 of various sizes and specifications. The packing assembly may formulate the most suitable packing plan based on a list of the items, select the optimal package carton 300 specification, and adjust the posture of the execution unit 11 according to the picking plan to achieve packing of various types of items 90, enabling the package carton 300 to be packed according to the preset packing plan. This helps improve the volume utilization rate of a package carton 300, thereby reducing the size of the package carton 300, and ultimately saving logistics transportation costs. The packing assembly requires no manual intervention throughout the process, has a high level of automation, helps save labor costs, and achieves the purpose of reducing costs and increasing efficiency.

According to some embodiments of the present application, a carton void filling method, including the following steps:

S100: An item container 21 is loaded with corresponding items 90 according to an item list in the previous process and comes with a label of information code of the item list. Before the item container 21 reaches a pick-up station 20, a plurality of scanners 30 scan the information code of the item container 21. a controller of a packing assembly obtains product parameters of all items 90 in the item container 21 based on the information code and inputs product parameters of the items 90 into a packing model. The packing model derives the best match packing plan from a training library.

S200: When the item container 21 reaches the pick-up station 20, a plurality of visual probes 40 capture images of the items 90 inside the item container 21. According to a principle of top-down retrieval, the controller sorts the items 90 in the item container 21 and plans the best picking posture based on each placement posture of the items 90, thereby generating a picking plan. Since each placement postures of the items 90 in the item container 21 varies, in order to enable an execution unit 11 of a multi-axis robot 10 to correctly pick up each item 90, the controller needs to plan the best picking postures based on the placement postures of the items 90, and a second pick-up mechanism 12 of the execution unit 11 is arranged to face a respective surface of an item 90, so that a code reader 50 is allowed to read an associated identification code of the item 90.

S300: A multi-axis robot 10 sequentially picks up items 90 from the item container 21 according to a picking plan. The code readers 50 read the identification code of each picked item 90. By comparing the picking plan with the packing plan, the controller controls the multi-axis robot 10 to carry items 90 that are not in their turn for packing and temporarily store them onto the buffer station 60, so that a package carton 300 is packed according to the packing plan. There are multiple code readers 50. At least one code reader 50 is set on the execution unit 11. If the identification code of an item 90 happens to face the execution unit 11, the execution unit 11 may directly read the identification code of the item 90 through the code reader 50 after pick-up. If the identification code of the item 90 does not face the execution unit 11, the execution unit 11 needs to move the item 90 to a reading area equipped with multiple code readers 50 and rotate the item 90 so that one of the code readers 50 may read its identification code.

S400: The package carton 300 is reserved with gaps according to the packing plan. The controller plans a filling path for a movable frame 13 according to a coordinate data of the gaps in the packing plan, enabling an acquisition unit 420 to be positioned at a target gap in the package carton 300. Meanwhile, a void fill dispenser 70 processes void fill material of corresponding size and specification according to the packing plan.

S500: A first pick-up mechanism 100 picks up void fill material dispensed from the void fill dispenser 70. A movement mechanism moves the first pick-up mechanism 100 to the target gap in the package carton 300 according to the filling path. The first pick-up mechanism 100 releases the picked void fill material into the target gap.

S600: A compression mechanism 200 drives a pressing part 220 to extend along a first direction through a second actuation device 210, to further press the void fill material into the target gap.

S700: After filling all gaps in the package carton 300, the first pick-up mechanism 100 picks up void fill material again from the void fill dispenser 70. The movement mechanism moves the first pick-up mechanism 100 to a filling opening of the package carton 300. The first pick-up mechanism 100 releases the picked void fill material in the inner top space of the package carton 300.

S800: The compression mechanism 200 drives the pressing part 220 to extend along the first direction through the second actuation device 210, to further press the void fill material in the inner top space of the package carton 300.

Since the carton void filling method is performed with features of the solutions of the above device embodiments, it has at least all the beneficial effects brought by the device embodiments, which will not be repeated here.

The above describes the embodiments of the present application in detail with reference to the drawings, but the present application is not limited to the above embodiments. Within the knowledge of those of ordinary skill in the art, various changes may be made without departing from the scope of the present application.

What claimed is:

1. A package carton void filling device, comprising:

a movement mechanism, provided with a movable frame, wherein the movable frame moves along a filling path under the driving of the movement mechanism;

a controller, configured to plan the filling path according to gaps in a package carton;

a first pick-up mechanism, comprising a connection seat connected to the movable frame, and an acquisition unit connected to the connection seat, wherein the acquisition unit has a first state and a second state and is configured to pick or release void fill material by switching between the first state and the second state;

a compression mechanism, connected to the connection seat, and provided with a pressing part, wherein the pressing part moves along a path of a first direction under the driving of the compression mechanism for pressing and filling the material into the gaps.

2. The package carton void filling device according to claim 1, wherein, the acquisition unit has two clamping parts, a clamping space is formed between the two clamping parts, and the acquisition unit is configured to adjust an opening width of the clamping space by controlling the relative positions of the two clamping parts.

3. The package carton void filling device according to claim 2, wherein, the acquisition unit adjusts the opening width of the clamping space based on the gap dimensions of the package carton.

4. The package carton void filling device according to claim 2, wherein, a first actuation device is arranged on the acquisition unit and connected to the connection seat, and the first actuation device is provided with a first movable part, the first actuation device is connected to at least one of the two clamping parts through the first movable part and is configured to adjust the opening width of the clamping space by changing the relative positions of the two clamping parts.

5. The package carton void filling device according to claim 2, wherein, a rotation mechanism is provided between the movement mechanism and the movable frame, or between the movable frame and the connection seat, and the rotation mechanism has a rotation axis arranged along the first direction.

6. The package carton void filling device according to claim 2, further comprising at least two first pick-up mechanism, wherein, a respective connection seat of any one of the first pick-up mechanisms is connected to the movable frame through a quick-release structure, and each first pick-up mechanisms has a clamping part of a varied length.

7. The package carton void filling device according to claim 1, wherein, the acquisition unit is provided with a negative pressure adsorption component, the negative pressure adsorption component is connected with a negative pressure channel, and a control valve is provided on the negative pressure channel.

8. The package carton void filling device according to claim 1, wherein, the compression mechanism further comprises the pressing part and a second actuation device, the second actuation device is connected to the connection seat and provided with a second movable part, and the second movable part is connected to the pressing part, so that the second actuation device is capable of driving the pressing part to move along the first direction.

9. The package carton void filling device according to claim 1, further comprising a visual detection unit, wherein, the visual detection unit has a detection direction toward the interior of the package carton, and the controller plans the filling path through the visual detection unit.

10. A packing assembly, comprising:

a packing device, comprising:

a pick-up station configured for placing an item container containing items, a multi-axis robot provided with an execution unit, and the execution unit is connected with a second pick-up mechanism for picking and releasing items, a plurality of scanners, a plurality of visual probes, a plurality of code readers, a buffer station, a packing station configured for storing a package carton to be filled, and a void fill dispenser, wherein the execution unit is movable among the pick-up station, the buffer station, and the packing station, wherein a controller generates a packing plan when the scanners scan an information code of the item container and generates a picking plan when the visual probes capture images of the items in the item container, wherein the multi-axis robot sequentially picks up the items from the item container according to the picking plan, wherein the code readers read an identification code of each picked item, wherein the multi-axis robot carries items that not scheduled for a current packing round onto the buffer station for temporary storage, by comparing the picking plan with the packing plan, so that the package cartons are packed according to the packing plan; and the package carton void filling device according to claim 1, wherein the first pick-up mechanism picks up void fill material dispensed from the void fill dispenser, and the controller plans the filling path for the movable frame according to the packing plan.

11. The packing assembly according to claim 10, wherein, the multi-axis robot serves as the movement mechanism, and the movement range of the execution unit is extended to include the void fill dispenser.

12. The packing assembly according to claim 11, wherein, the execution unit is connected with the second pick-up mechanism and the first pick-up mechanism through the movable frame, and the execution unit activates the second pick-up mechanism or the first pick-up mechanism by rotating the movable frame.

13. A method for filling a gap in a package carton, applying the packing assembly according to claim 10, and the method comprises:

generating, by the controller, the packing plan when a plurality of scanners scan an information code of an item container;

generating, by the controller, the picking plan when a plurality of visual probes capture images of items in the item container;

picking, by a multi-axis robot, items in a sequence from the item container according to the picking plan;

reading, by a plurality of code readers, an identification code of each picked item;

carrying, by the multi-axis robot, items that not scheduled for the current packing round onto the buffer station for temporary storage, when comparing the picking plan with the packing plan, so that the package cartons are packed according to the packing plan;

planning, by the controller, a filling path for the movable frame according to a coordinate data of gaps in the packing plan, in a case that the package carton is reserved with gaps according to the packing plan;

picking, by the first pick-up mechanism, void fill material dispensed from the void fill dispenser;

moving, by the movement mechanism, the first pick-up mechanism to a respective gap in the package carton according to the filling path;

releasing, by the first pick-up mechanism, the picked void fill material into a target gap;

pressing, by a pressing part under the driving of a compression mechanism, the void fill material further into the target gap.

14. The method according to claim 13, wherein, after the compression mechanism further presses the void fill material into the target gap by moving the pressing part, the carton void filling method further comprises:

picking, by the first pick-up mechanism, void fill material dispensed from the void fill dispenser;

moving, by the movement mechanism, the first pick-up mechanism to a filling opening of the package carton;

releasing, by the first pick-up mechanism, the picked void fill material into an inner top space of the package carton; and pressing, by the pressing part under the driving of the compression mechanism, the void fill material further into the inner top space of the package carton.

15. The method according to claim 13, wherein, when the first pick-up mechanism picks up void fill material dispensed from the void fill dispenser, further comprises:

dispensing, by the void filling device, void fill material of a corresponding size and specification according to the packing plan.

* * * * *